United States Patent [19]

Jackson et al.

[11] Patent Number: 5,026,522

[45] Date of Patent: Jun. 25, 1991

[54] NB-TI-HF HIGH TEMPERATURE ALLOYS

[75] Inventors: Melvin R. Jackson, Schenectady; Shyh-Chin Huang, Latham, both of N.Y.

[73] Assignee: General Electric Company, Schenectady, N.Y.

[21] Appl. No.: 288,667

[22] Filed: Dec. 22, 1988

[51] Int. Cl.[5] ..... C22C 27/00

[52] U.S. Cl. ..... 420/426; 420/425

[58] Field of Search ..... 420/425, 426

[56] References Cited

U.S. PATENT DOCUMENTS 3,027,255 3/1962 Begley et al. ..... 75/174
3,753,699 8/1973 Anderson Jr. et al. ..... 420/426

FOREIGN PATENT DOCUMENTS 1464036 11/1966 France .
0002818 2/1968 Japan ..... 420/426
0021357 6/1972 Japan ..... 420/426

*Primary Examiner*—Upendra Roy
*Attorney, Agent, or Firm*—Paul E. Rochford; James C. Davis, Jr.; James Magee, Jr.

[57] ABSTRACT

An alloy is provided which has good operating strength and ductility at temperatures of 2000° to 2500° F. and density of between 7.0 and 7.3. The alloy contains niobium titanium and hafnium in concentrations as set forth below:

| Ingredient | Concentration in Atom % From | To |
|---|---|---|
| Niobium | balance essentially | |
| Titanium | 35 | 45 |
| Hafnium | 10 | 15. |

6 Claims, 2 Drawing Sheets

NB-TI-HF HIGH TEMPERATURE ALLOYS

CROSS REFERENCE TO RELATED APPLICATIONS

The subject application relates to application Ser. No. 202,357, filed June 6, 1988. It also relates to applications Ser. No. 280,085, filed Dec. 5, 1988; Ser. No. 279,640, filed Dec. 5, 1988; Ser. No. 279,639, filed Dec. 5, 1988; Ser. No. 290,399, filed Dec. 29, 1988; and to Ser. No. 288,394, filed Dec. 22, 1988. The text of the related application is incorporated herein by reference.

BACKGROUND OF THE INVENTION

The present invention relates generally to alloys and to shaped articles formed for structural use at high temperatures. More particularly, it relates to a base alloy containing niobium, titanium and hafnium. By a base alloy is meant that by itself it is a valuable alloy but it is also an alloy which can be improved by incorporation of other additive elements.

There are a number of uses for metals which have high strength at high temperature.

In the field of high temperature alloys and particularly alloys displaying high strength at high temperature, there are a number of concerns which determine the field applications which can be made of the alloys. One such concern is the compatibility of an alloy in relation to the environment in which it must be used. Where the environment is the atmosphere, this concern amounts to a concern with the oxidation or resistance to oxidation of the alloy.

Another such concern is the density of the alloy. One of the groups of alloys which is in common use in high temperature applications is the group of iron-base, nickel-base, and cobalt-base superalloys. The term "base", as used herein, indicates the primary ingredient of the alloy is iron, nickel, or cobalt, respectively. These superalloys have relatively high densities of the order of 8 to 9 g/cc. Efforts have been made to provide alloys having high strength at high temperature but having significantly lower density.

It has been observed that the mature metal candidates for use in applications needing high strength at high temperature can be grouped and such a grouping is graphically illustrated in FIG. 1. Referring now to FIG. 1, the ordinate of the plot shown there is the density of the alloy and the abscissa is the temperature range, including the maximum temperature at which the alloy provides useful structural properties for aircraft engine applications. The prior art alloys in this plot are discussed in descending order of density and use temperatures.

With reference to FIG. 1, the materials of highest density and highest use temperatures are those enclosed within an envelope marked as Nb-base and appearing in the upper right hand corner of the figure. Densities range from about 8.7 to about 9.7 grams per cubic centimeter and use temperatures range from less than 2200° F. to about 2600° F.

Referring again to FIG. 1, the group of prior art iron, nickel, and cobalt based superalloys are seen to have the next highest density and also a range of temperatures at which they can be used extending from about 500° C. to about 1200° C.

A next lower density group of prior art alloys are the titanium-base alloys. As is evident from the figure, these alloys have a significantly lower density than the superalloys but also have a significantly lower set of use temperatures ranging from about 200° F. to about 900° F.

The last and lowest density group of prior art alloys are the aluminum-base alloys. As is evident from the graph, these alloys generally have significantly lower density. They also have relatively lower temperature range in which they can be used, because of their low melting points.

A novel additional set of alloys is illustrated in the figure as having higher densities than those of the titanium-base alloys, but lower densities than those of the superalloys ranging between 7.0 and 7.3 gm/cm$^3$. These alloys have useful temperature ranges potentially extending beyond the superalloy temperature range. These ranges of temperature and density include those for the alloys such as are provided by the present invention and which are formed with niobium, titanium and hafnium.

BRIEF STATEMENT OF THE INVENTION

It is, accordingly, one object of the present invention to provide an alloy system which has substantial strength at high temperature relative to its weight.

Another object is to reduce the weight of the elements presently used in higher temperature applications.

Another object is to provide an alloy and structural members which can be employed where high strength is needed at high temperatures.

Other objects will be in part apparent and in part pointed out in the description which follows.

In one of its broader aspects, objects of this invention can be achieved by providing an alloy of niobium, titanium and hafnium with ingredient concentrations within the following ranges:

| Ingredient | Concentration in Atom % From | To |
|---|---|---|
| niobium | balance essentially | |
| titanium | 35 | 45 |
| hafnium | 10 | 15 |

As used herein, the phrase "balance essentially" is used to include, in addition to niobium in the balance of the alloy, small amounts of impurities and incidental elements, which in character and amount do not adversely affect and may improve the advantageous aspects of the alloy.

BRIEF DESCRIPTION OF THE DRAWINGS

The description of the invention which follows will be understood with greater clarity if reference is made to the accompanying drawings in which.

DETAILED DESCRIPTION OF THE INVENTION

Figure 1:
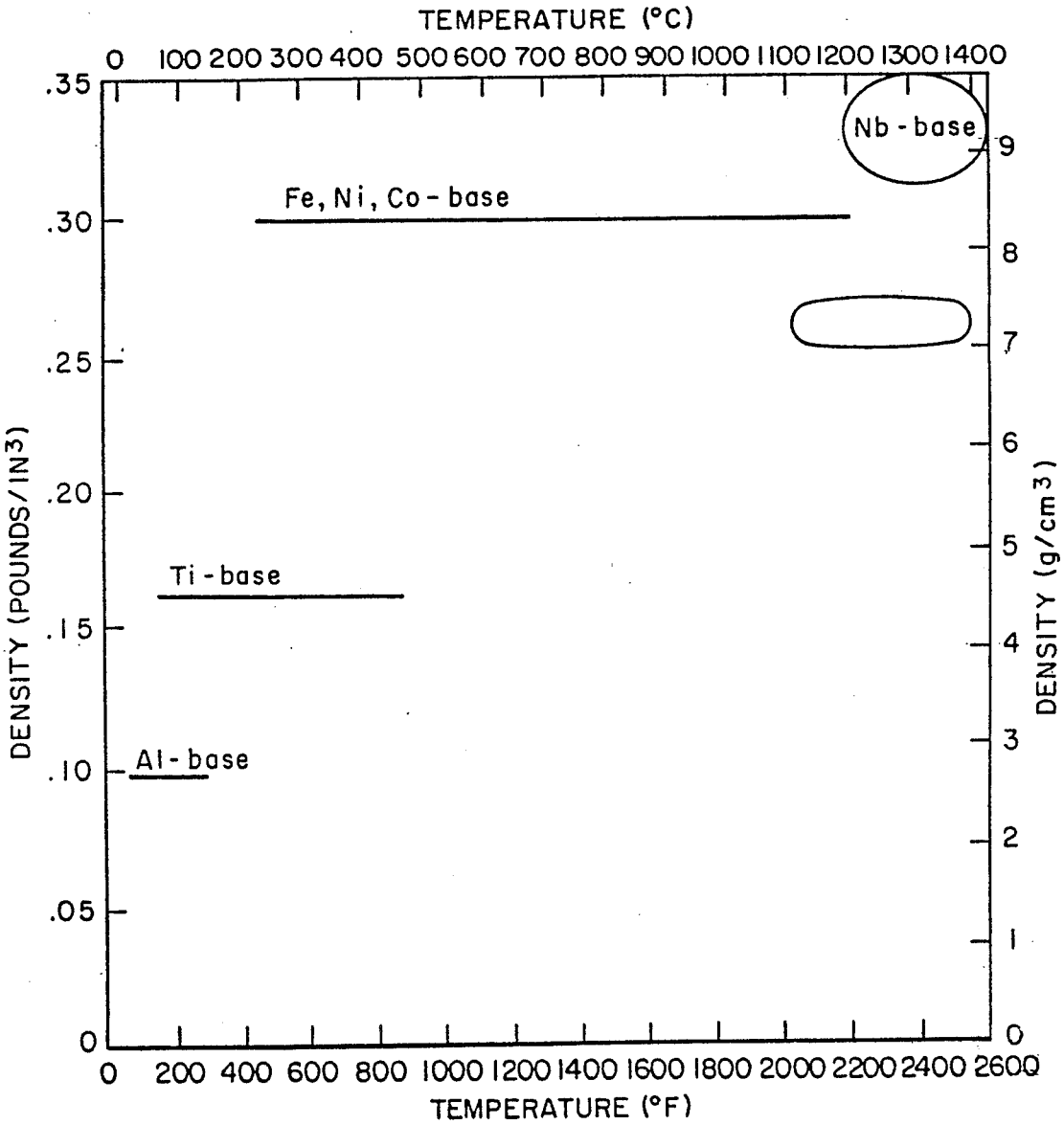
FIG. 1 is a graph in which density of an alloy is plotted against the use temperature, the centigrade temperatures being shown on a lower scale and the Fahrenheit temperatures on the upper scale.

It is known that intermetallic compounds, that is metal compositions in which the ingredients are at concentration ratios which are very close to stoichiometric ratios, have many interesting and potentially valuable properties. However, many of these intermetallic compounds are brittle at lower temperatures or even at higher temperatures and, for this reason, have not been used industrially. It is valuable to have alloy compositions which are not dependent on the intermetallic ratios of ingredients and which have good ductility at elevated temperatures and also at moderate and lower temperatures. What is even more valuable is an alloy composition, the ingredients of which can be varied over a range and which has both high strength at higher temperatures and also good ductility over a range of temperatures. The compositions of the present invention meet these criteria. The temperature range of which they are useful extends from less than 2000° F. to over 2500° F. This useful temperature range is illustrated in FIG. 1. Also in FIG. 1, the density range of the compositions of the present invention extending from about 7.0 to about 7.3 is illustrated in the Figure. A composition in which the density is at a lower range contains between 8 and 10 atom percent hafnium.

EXAMPLE 1

An alloy composition was prepared as is set forth in Table I (in atom percent) immediately below.

TABLE I

| Example | Ingredient and Concentration | | |
|---|---|---|---|
| | Nb | Ti | Hf |
| 1 | 44 | 44 | 12 |

The melt which was prepared was formed into a ribbon by a rapid solidification process. The rapid solidification involved causing the metal to undergo a very large cooling rate. There are several methods by which the requisite large cooling rates may be obtained. One such process is a melt spinning cooling. A preferred laboratory method for obtaining the requisite cooling rates is the chill-block melt spinning process. Briefly and typically, in the chill-block melt spinning process, molten metal is delivered from a crucible through a nozzle, usually under the pressure of an inert gas, to form a free standing stream of liquid metal or a column of liquid metal in contact with the nozzle which is then impinged onto or otherwise placed in contact with the rapidly moving surface of a chill-block, i.e. a cooling substrate, made of material such as copper. The material to be melted can be delivered to the crucible as separate solids of the elements required and melted therein by means such as an induction coil placed around the crucible. Alternatively, the alloys such as the alloys described above for Example 1 can be introduced into the crucible and melted therein.

When the liquid melt contacts the cold chill-block, it cools rapidly, from about $10^{3}$° C. per second to $10^{7}$° C. per second and solidifies in the form of a relatively continuous length of a thin ribbon whose width is considerably larger than its thickness. A more detailed teaching of the chill-block melt spinning process may be found, for example, in U.S. Pat. Nos. 2,825,108; 4,221,257; and 4,282,921, the texts of which patents are incorporated herein by reference.

The ribbons prepared in this fashion were consolidated in a conventional fashion by HIPing. Conventional HIPing is a process involving simultaneous application of heat and pressure at levels which bond the ribbons together into a solid without melting.

Conventional tensile test bars were prepared from the consolidated ribbon sample and conventional tensile tests were run at room temperature, 760° C., 980° C., and 1200° C., for the sample of alloy which had been prepared. The results of these tests are presented in Table II below.

TABLE II

| Example | Test Temp. | Yield Strength | Ultimate Strength | Reduction in Area |
|---|---|---|---|---|
| 1 | 23° C. | 107 ksi | 107 ksi | 41% |
| | 760° C. | 49 | 53 | 77 |
| | 980° C. | 30 | 30 | 94 |
| | 1200° C. | 14 | 14 | 95 |

From the data presented in Table II, it is evident that the alloy has substantial room temperature strength. The measurements at the higher temperatures of 760° C., 980° C. and 1200° C. indicate that the alloy has very significant strength at these higher temperatures.

Figure 2:
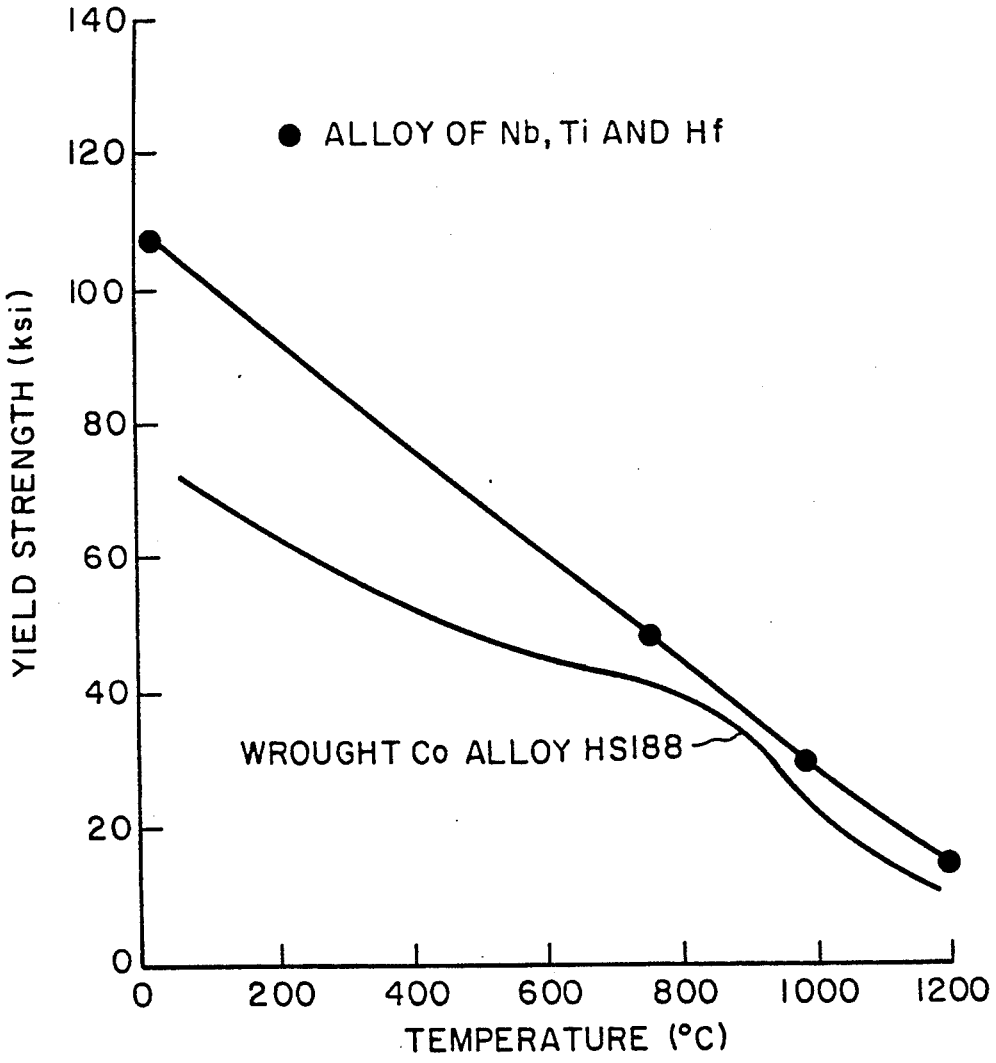
FIG. 2 is a graph in which temperature in degrees centigrade is plotted against yield strength in ksi for an alloy as provided pursuant to the present invention, in comparison to an alloy which is presently commercially available.

Tensile yield strength results are shown in FIG. 2 for the alloy of the present invention. Also shown is the tensile yield strength of a wrought co-base alloy HS-188, a material used for high temperature sheet metal applications. The alloy of the present invention is superior at all test temperatures, and is also 20% lighter in weight for the same volume of material.

Ductility at elevated temperature is good for all temperatures. However, room temperature ductility is very good and ductility at this temperature is usually most critical for ease of fabricability for alloys to be used at high temperature and to furnish high strength.

TABLE III

| | Weight Gain in Oxidative (Air) Exposure | |
|---|---|---|
| | Commercial Alloy Cb-752 | NbTiHf Alloy of Example 1 |
| 800° C. | 1 hour - 22.5 mg/cm$^2$ | 16 hours - 8.4 mg/cm$^2$<br>35 hours - 12.4 mg/cm$^2$ |
| 1000° C. | 1 hour - sample consumed | 1 hour - 7.3 mg/cm$^2$<br>3 hours - 12.0 mg/cm$^2$<br>9 hours - severe spalling |
| 1200° C. | 1 hour - sample consumed | 1 hour - 37.1 mg/cm$^2$<br>2 hours - 66.7 mg/cm$^2$ |

Samples of the alloy were exposed in air at temperatures of 800°, 1000°, and 1200° C., and a comparison piece of the commercial alloy Cb752 was also exposed. Samples of the example alloy were 0.064–0.074 cm in thickness, and the Cb752 was 0.076 cm thick. Data for the tests are shown in Table III. The commercial alloy oxidized very quickly, being consumed in 1 hour at 1200° and 1000° C., and being severely attacked in 1 hour at 800° C. The alloy of Example 1 shows a clear advantage at all three test conditions.

The alloy of this invention can also be prepared effectively by conventional ingot metallurgical techniques.

What is claimed and sought to be protected by Letters Patent of the United States is as follows:

1. An alloy consisting essentially of the following ingredients and ingredient concentrations in atomic percent:

| Ingredient | Concentration in Atom % | |
|---|---|---|
| | From | To |
| Niobium | balance essentially | |
| Titanium | 35 | 45 |
| Hafnium | 10 | 15. |

2. The alloy of claim 1, in which the titanium concentration is between 40 and 45 atomic percent.

3. The alloy of claim 1, in which the titanium concentration is between 42 and 45 atomic percent.

4. The alloy of claim 1, in which the hafnium concentration is between 10 and 12 atomic percent.

5. The alloy of claim 1 in which the hafnium concentration is approximately 12 atomic percent.

6. The alloy of claim 1, in which the titanium concentration is between 40 and 45 atomic percent and the hafnium concentration is between 10 and 12 atomic percent.

* * * * *